United States Patent [19]

Murata

[11] Patent Number: 4,666,040

[45] Date of Patent: May 19, 1987

[54] SMALL ARTICLE HOLDING PACKAGE

[75] Inventor: Takaaki Murata, Kumamoto, Japan

[73] Assignee: Aso Pharmaceutical Co., Ltd., Kumamoto, Japan

[21] Appl. No.: 736,926

[22] Filed: May 21, 1985

[51] Int. Cl.[4] ..... B65D 83/08; B65D 27/08

[52] U.S. Cl. ..... 206/441; 206/232; 206/440; 206/469; 206/489

[58] Field of Search ..... 206/232, 439, 440, 441, 206/489, 467, 469; 229/40; 40/2 R, 159, 594

[56] References Cited

U.S. PATENT DOCUMENTS

| | | | |
|---|---|---|---|
| B. 456,153 | 3/1976 | Anderson | 40/159 |
| 864,648 | 8/1907 | Jaeger | 40/159 |
| 1,175,835 | 3/1916 | Streit | 229/40 |
| 1,722,232 | 7/1929 | Pollock | 40/159 |
| 2,056,067 | 9/1936 | Hihes | 206/477 |
| 2,209,657 | 7/1940 | Martin | 206/831 |
| 2,522,963 | 9/1950 | Rogers | 206/441 |
| 2,816,666 | 12/1957 | Nadel | 206/461 |
| 2,976,628 | 3/1961 | Breslow | 40/2 R |
| 3,153,868 | 10/1964 | Jones | 40/2 R |
| 3,162,306 | 12/1964 | Zackheim | 206/440 |
| 3,207,301 | 9/1965 | Sparks | 206/232 |
| 3,288,280 | 11/1966 | Bostrom | 206/461 |
| 3,298,513 | 1/1967 | Krooss et al. | 206/232 |
| 3,443,686 | 5/1969 | Raymond | 40/594 |
| 3,524,271 | 8/1970 | Buske | 40/2 R |
| 3,612,265 | 10/1971 | Dickerson | 206/441 |
| 3,745,679 | 7/1973 | Petrie | 40/2 R |
| 3,933,245 | 1/1976 | Muller | 206/461 |
| 4,204,706 | 5/1980 | Blum et al. | 40/2 R |
| 4,222,187 | 9/1980 | Huck | 40/594 |

FOREIGN PATENT DOCUMENTS

| | | | |
|---|---|---|---|
| 488740 | 12/1952 | Canada | 206/440 |
| 2163457 | 7/1973 | Fed. Rep. of Germany | 40/159 |
| 2232489 | 1/1974 | Fed. Rep. of Germany | 40/2 R |
| 2359422 | 6/1975 | Fed. Rep. of Germany | 40/159 |
| 2526194 | 11/1983 | France | 40/2 R |

*Primary Examiner*—William Price
*Assistant Examiner*—Brenda J. Ehrhardt
*Attorney, Agent, or Firm*—Armstrong, Nikaido, Marmelstein & Kubovcik

[57] ABSTRACT

This invention relates to packages for holding therein small articles, particularly those which are relatively thin or those which can be packed together into a sheet-like shape, the package comprising a base sheet having at least one small article placed on the front surface thereof and at least one cover sheet covering the small article for holding the small article between the base sheet and the cover sheet, the cover sheet having a marginal portion surrounding the small article and removably adhered to the base sheet surface so that the small article can be taken out from the package.

12 Claims, 5 Drawing Figures

SMALL ARTICLE HOLDING PACKAGE

This invention relates to packages for holding therein small articles, particularly those which are relatively thin or those which can be packed together into a sheet-like shape such as first-aid adhesive bandages, drugs in the form of tablets, granules or the like, tea, coffee, sugar and adhesive sheets bearing a magnet for magnetically treating stiff shoulder or the like.

When such small articles are to be distributed by the maker or stores as samples, or when a bank, company or the like other than the maker or the store is to give publicity to itself by utilizing the distribution of such small articles, it is general practice to place the small article into a bag and affix the bag to a base sheet, the bag or sheet bearing a product blurb and directions for use, a publicity notice for the company or the desired item of information (such notice or information will sometimes be referred to collectively as "information" hereinafter and in the appended claims).

However, when the small article held in the conventional package is to be used, it is necessary to remove the bag from the base sheet first and thereafter break the bag to take out the article. The article may be taken out more readily by rupturing the front side of the bag as attached to the base sheet, but it is then likely that the publicity notice or the like on the surface of the sheet beneath the bag will not attract attention.

Further when salesmen of the maker of the small article or employees of a bank, insurance company or the like carry article holding packages and visit customers for a publicity campaign for the article itself or for giving publicity to the company, the visitor frequently gives his name card to the customer to attract attention to himself or to his company. On such occasion, the name card, which is separate from the package, will be stowed in a desk drawer or the like instead of being held exposed to the view of the customer for a long period of time although the article may be used later.

Accordingly, an object of the present invention is to provide a small article holding package which is less bulky than the conventional package and from which the small article can be taken out easily, the package including a base sheet which has the small article placed thereon and the surface of which is exposed when the article is removed.

The above object of the present invention can be fulfilled by a small article holding package comprising a base sheet having at least one small article placed on the front surface thereof, and at least one cover sheet covering the small article for holding the small article between the base sheet and the cover sheet, the cover sheet having a marginal portion surrounding the small article and removably adhered to the base sheet surface so that the small article can be taken out from the package.

Another object of the present invention is to provide a small article holding package of the type described above wherein a name card can be readily attached to and removed from the rear surface of the base sheet.

This object of the invention can be fulfilled by a small article holding package of the type described above wherein the base sheet is formed with card insertion slits for retaining a name card on the rear surface of the base sheet.

Still another object of the present invention is to provide a small article holding package which is advantageously usable for publicizing small articles or for giving publicity to the dispenser of small articles.

This object of the invention can be fulfilled by a small article holding package of the type described above wherein information is printed on one of the base sheet front surface, the base sheet rear surface and the cover sheet.

With the packages of the invention stated above, the cover sheet can be adhered to the base sheet, for example, with a suitable known pressure-sensitive adhesive, such as an adhesive consisting essentially of a copolymer of acrylic resin and natural crude rubber.

It is desirable that when the cover sheet is adhered to the base sheet, the peripheral edge of the cover sheet be at least partly left unadhered to the base sheet surface so that the unadhered portion can be nipped by fingers when the cover sheet is to be peeled off.

When the package holds a plurality of small articles and has the corresponding number of cover sheets, the cover sheets can be in the form of a continuous sheet which has a cut line at the boundary between the adjoining cover sheets.

The base sheet and the cover sheet can be prepared from a suitable known material such as paper, synthetic resin or a combination thereof.

The above and other objects, features and advantages of the invention will become apparent from the following description of the invention with reference to the accompanying drawings which are given for illustrative purposes only and to which the invention is not limited. In these drawings.

Figure 1:
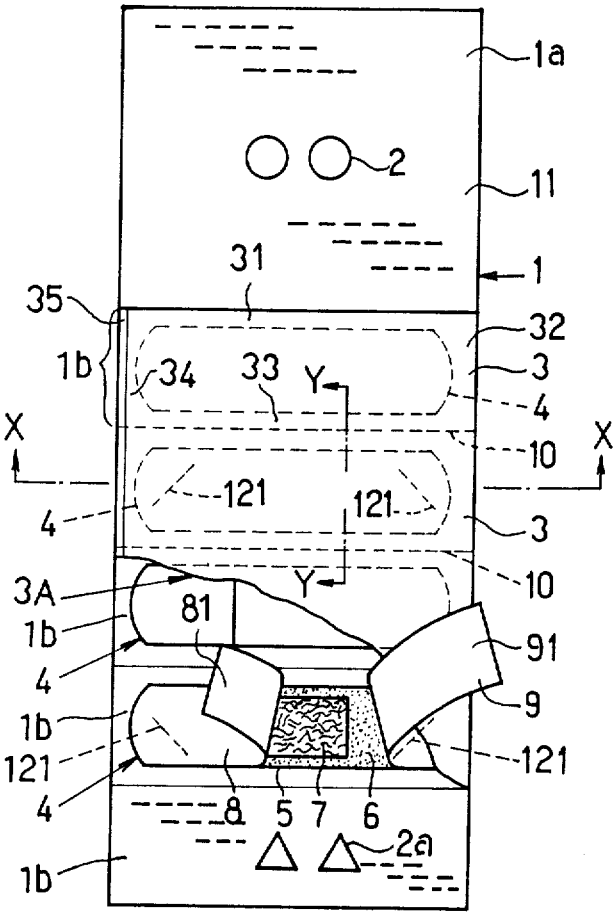
FIG. 1 is a front view showing an embodiment of the invention, with the lowermost cover sheet and adhesive bandage removed, two cover sheets above the lowermost one being partly broken away, peel paper for one adhesive bandage being partly peeled.
Figure 3:
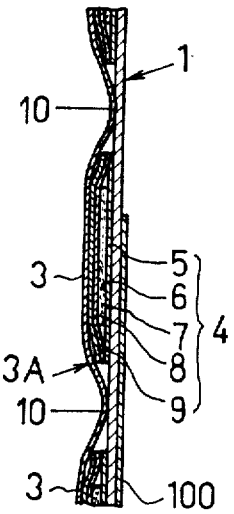
FIG. 3 is an enlarged view in section taken along the line Y—Y in FIG. 1.
Figure 2:
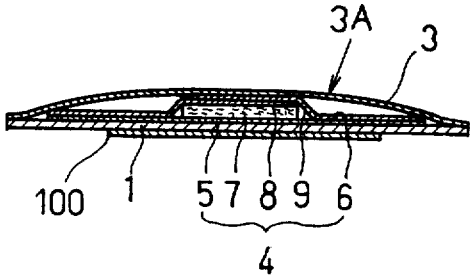
FIG. 2 is an enlarged view in section taken along the line X—X in FIG. 1.

The illustrated embodiments are packages for holding therein adhesive bandages as small articles.

The package shown in FIGS. 1 to 4 comprises a base sheet 1 of paper, a plurality of first-aid adhesive bandages 4 and cover sheets 3 of thin paper. The base sheet 1 is in the form of a vertically elongated rectangle and has printed on its front and rear surfaces characters, devices, etc. for giving directions, a publicity notice or other information. The base sheet 1 has a width approximately equal to the length of the cover sheet 3 in the form of a horizontally elongated rectangle and to be described below. The print of characters, etc. for the publicity notice or the like on the front surface 11 of the base sheet 1 includes a print portion 1*a* bearing characters 2, etc. and having a suitable length from the upper end of the base sheet 1. The lower portion of the base sheet front surface other than the print portion 1*a* is divided into sections 1*b* having a vertical width equal to the width of the cover sheet 3. These sections 1*b* have printed thereon different directions, publicity messages or the like 2*a*.

As shown in FIG. 1, the first-aid adhesive bandage 4 comprises a piece of tape 5 having an adhesive layer 6 on its one surface, a pad 7 of gauze or the like attached to the center of the adhesive layer 6 and having or not having a suitable drug applied thereto, and opposite peel pieces 8, 9 covering the pad 7 and provided over the adhesive layer 6. Over the pad 7, the peel pieces 8, 9 have overlappping end portions 81, 91, which are pulled to peel the pieces 8, 9 off the adhesive layer 6. Both ends of the tape 5 and the outer ends of the peel pieces 8, 9 each have an arcuate edge.

The adhesive bandage 4 is placed on each section 1*b*, with the tape 5 in direct contact therewith. The lower surface of the tape 5 may be removably adhered, at its opposite ends, to the front surface of the base sheet 1.

The cover sheet 3 covers the adhesive bandage 4 and is provided over each section 1*b*. The cover sheet 3 has marginal portions 31, 32, 33 and 34 surrounding the bandage 4 and removably adhered to the front surface 11 of the base sheet 1 with a pressure-sensitive adhesive which consists essentially of a copolymer of acrylic resin and natural crude rubber. The cover sheet 3 is left unadhered to the base sheet 1 at the edge 35 of its one end.

The cover sheets 3 are in the form of a single sheet of cover paper 3A. The cover paper 3A has a length to cover the base sheet 1 from the uppermost section 1*b* to the lowermost section 1*b*, substantially the same width as the base sheet 1, and cut lines 10 each in the form of aligned perforations or incisions and extending widthwise of the paper, the cut lines 10 being arranged at a spacing equal to the vertical width of the section 1*b*. The cut lines 10 provide the plurality of cover sheets 3 conforming to the shape of each section 1*b*. When required, characters or the like, for example, for publicity may be printed on the surface of each cover sheet 3.

Accordingly, any one of the cover sheets 3 can be peeled off the base sheet 1 by pulling the sheet 3 at its edge 35 nipped by fingers to separate the sheet 3 from the adjoining sheet(s) 3 along the cut line(s) 10, whereupon the adhesive bandage 4 can be taken out for use. The removal of the bandage from the section 1*b* on the base sheet 1 where the bandage was held exposes that section 1*b*, causing the user to take notice of the characters or the like 2*a* printed thereon.

Figure 4:
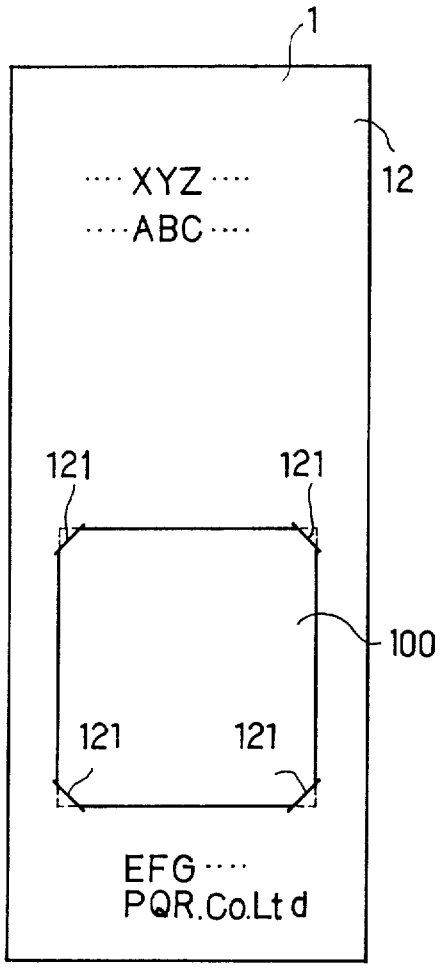
FIG. 4 is a rear view of the package of FIG. 1.

As seen in FIG. 4, the base sheet 1 is formed with four slits 121 for retaining a name card 100 on the rear surface 12 of the sheet 1. By inserting the four corners of the name card 100 into the slits 121, the name card 100 can be removably retained on the base sheet rear surface 12.

Figure 5:
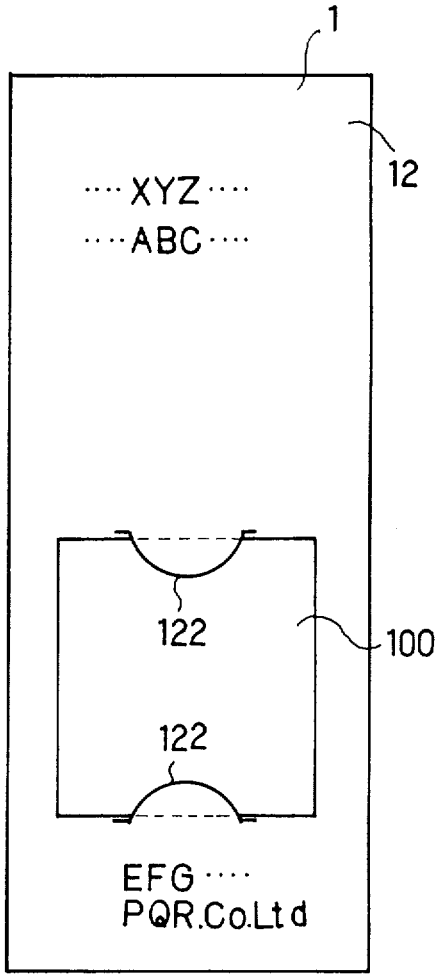
FIG. 5 is a rear view showing a card retaining base sheet having different card retaining slits.

The slits shown in FIG. 4 can be replaced by a pair of slits 122 as shown in FIG. 5. These slits 122 are so arranged that the name card to be retained will be positioned in the center of the base sheet portion providing the sections 1*b*. The slits are bulged toward each other in the form of an arc. The upper and lower midportions of the name card 100 are inserted into the slits 122, whereby the card is retained on the rear surface 12 of the base sheet 1.

In either case, it is desirable that the card retaining slit be formed at a portion of the base sheet other than where the cover sheet 3 is adhered to the base sheet 1, for example, at the portion covered with the bandage 4. This arrangement has the advantage that the portion of the card inserted in the slit is hidden by the adhesive bandage 4 and will not render the package unsightly.

Although the cover sheets 3 of the above package are continuous with one another and made separable at the cut lines 10, the adhesive bandages 4 may be covered with separate cover sheets individually, provided that each bandage 4 is packaged as held between the cover sheet 3 and the front surface 11 of the base sheet 1. When required, a plurality of adhesive bandages 4 may be arranged side by side over the entire area of the base sheet surface 11 including the print portion 1*a*.

The foregoing is a description of preferred embodiments of the invention, and it will be understood that various modifications may be made without departing from the spirit of the invention or the scope of the appended claims.

I claim:

1. A small article holding package comprising a base sheet having small articles placed but not adhered on the front surface thereof and a plurality of cover sheets each covering a small article for holding the small article between the base sheet and the cover sheet, each said cover sheet including means for removably adhering to the base sheet with the adhered portions of the cover sheet completely surrounding the small article to leave no marginal portion open and thus maintain said article in antiseptic state, each cover sheet further including means for peeling it off the base sheet to take out the small article from the package while keeping the base sheet substantially intact.

2. A package as defined in claim 1, wherein the base sheet has card insertion slits for retaining a name card on the rear surface of the base sheet.

3. A package as defined in claim 2, wherein the base sheet has said card insertion slits at the portions of the base sheet on which the small articles are placed.

4. A package as defined in claim 1, wherein said means for adhering the cover sheeet to the base sheet is a pressure-sensitive adhesive.

5. A package as defined in claim 4, wherein the adhesive consists essentially of a copolymer of acrylic resin and natural crude rubber.

6. A package as defined in claim 1, wherein said means for peeling includes a peripheral edge portion of each cover sheet not adhered to the base sheet surface so that the unadhered portion can be nipped by fingers when the cover sheet is to be peeled off.

7. A package as defined in claim 1, in which the cover sheets are arranged together in the form of a continuous sheet having a cut line at the boundary between the adjoining cover sheets.

8. A package as defined in claim 7, wherein the cut line is in the form of perforations.

9. A package as defined in claim 7, wherein the cut line is in the form of an incision.

10. A package as defined in claim 1, wherein at least part of the base sheet bears information.

11. A package as defined in claim 1, wherein the portions of the base sheet covered with the cover sheets bear information.

12. A package as defined in claim 1, wherein the cover sheets bear information.

* * * * *